US010369078B2

(12) United States Patent
Bhargava et al.

(10) Patent No.: US 10,369,078 B2
(45) Date of Patent: Aug. 6, 2019

(54) DUAL-CHAMBER PACK FOR PHARMACEUTICAL COMPOSITIONS

(71) Applicant: SUN PHARMACEUTICAL INDUSTRIES LIMITED, Mumbai, Maharashtra (IN)

(72) Inventors: Rahul Bhargava, New Delhi (IN); Bhupesh Kumar Mittal, Alwar (IN)

(73) Assignee: Sun Pharmaceutical Industries Limited, Mumbai (IN)

( * ) Notice: Subject to any disclaimer, the term of this patent is extended or adjusted under 35 U.S.C. 154(b) by 0 days.

(21) Appl. No.: 15/144,098

(22) Filed: May 2, 2016

(65) Prior Publication Data

US 2017/0312177 A1 Nov. 2, 2017

(51) Int. Cl.

| | |
|---|---|
| ***A61J 1/20*** | (2006.01) |
| ***A61J 1/18*** | (2006.01) |
| ***B65D 51/28*** | (2006.01) |
| ***A61J 1/14*** | (2006.01) |

(52) U.S. Cl.

CPC ..... *A61J 1/2093* (2013.01); *A61J 1/1418* (2015.05); *A61J 1/18* (2013.01); *B65D 51/2835* (2013.01); *A61J 1/2027* (2015.05)

(58) Field of Classification Search

CPC ..... A61J 1/2093; A61J 1/2003; A61J 1/18; B65D 51/2821; B65D 25/085; B65D 51/2814; B65D 51/2835; B65D 51/285

USPC ..... 206/219–222; 229/101

See application file for complete search history.

(56) References Cited

U.S. PATENT DOCUMENTS

| | | | | |
|---|---|---|---|---|
| 3,156,369 A | | 11/1964 | Bowes et al. | 215/6 |
| 3,603,469 A | | 9/1971 | Magni | 215/6 |
| 3,632,645 A | | 1/1972 | Bream et al. | |
| 3,687,076 A | * | 8/1972 | Friant | B65D 81/3222 102/331 |
| 3,840,136 A | | 10/1974 | Lanfranconi et al. | 215/6 |
| 3,917,063 A | | 11/1975 | Chibret et al. | |
| 4,024,952 A | | 5/1977 | Leitz | |
| 4,982,875 A | | 1/1991 | Pozzi et al. | 222/83 |
| 5,058,770 A | | 10/1991 | Herold et al. | 222/80 |

(Continued)

FOREIGN PATENT DOCUMENTS

| | | |
|---|---|---|
| CH | 567 978 | 10/1975 |
| EP | 1140027 B1 | 12/2005 |

(Continued)

OTHER PUBLICATIONS

Co-pending PCT Application No. PCT/IB2016/052488 filed May 2, 2016.

(Continued)

*Primary Examiner* — Chun Hoi Cheung

(57) ABSTRACT

The present invention relates to a dual-chamber pack with a first chamber comprising a container; and a second chamber comprising a reservoir, a biphasic connector, a plunger, and a plug with a breakable polymeric membrane. The container of the first chamber is prefilled with a pharmaceutically acceptable vehicle and the reservoir of the second chamber is prefilled with a solid composition of an active ingredient, wherein the solid composition of the active ingredient is mixed with the pharmaceutically acceptable vehicle to form a liquid pharmaceutical composition upon activation of the dual-chamber pack.

11 Claims, 6 Drawing Sheets

Reservoir - 1, Plunger - 2, Plug - 3, Breakable polymeric membrane - 4, Biphasic connector - 5, Tamper evident band - 6, Opening of the container -7, Container - 8, Cap - 9.

(56) References Cited

U.S. PATENT DOCUMENTS

| | | | | |
|---|---|---|---|---|
| 5,170,888 | A | 12/1992 | Goncalves | |
| 5,273,760 | A | 12/1993 | Oshlack et al. | |
| 5,419,445 | A | 5/1995 | Kaesemeyer | 215/11.1 |
| 5,431,915 | A | 7/1995 | Harvey et al. | |
| 5,460,828 | A | 10/1995 | Santus et al. | |
| 5,472,712 | A | 12/1995 | Oshlack et al. | |
| 5,854,290 | A | 12/1998 | Arnsten et al. | |
| 6,148,996 | A | 11/2000 | Morini | 206/222 |
| 6,156,340 | A | 12/2000 | Adeyeye et al. | |
| 6,287,599 | B1 | 9/2001 | Burnside et al. | |
| 6,676,966 | B1 | 1/2004 | Odidi et al. | |
| 6,811,794 | B2 | 11/2004 | Burnside et al. | |
| 6,890,957 | B2 | 5/2005 | Chandran et al. | |
| 7,214,387 | B2 | 5/2007 | Sanghvi et al. | |
| 7,748,550 | B2 * | 7/2010 | Cho | B65D 51/285 206/222 |
| 7,906,145 | B2 | 3/2011 | Castan et al. | |
| 8,002,734 | B2 | 8/2011 | Bassarab et al. | |
| 8,197,850 | B2 | 6/2012 | Castan et al. | |
| 8,297,456 | B1 * | 10/2012 | Anderson | B65D 51/222 206/222 |
| 8,318,210 | B2 | 11/2012 | Tengler et al. | |
| 8,453,833 | B2 * | 6/2013 | Porter | B65D 51/2828 206/222 |
| 8,491,935 | B2 | 7/2013 | Mehta et al. | |
| 8,541,018 | B2 | 9/2013 | Radke et al. | |
| 8,960,424 | B1 * | 2/2015 | Anderson | B65D 51/2835 206/219 |
| 9,132,950 | B1 | 9/2015 | Anderson et al. | |
| 2001/0032643 | A1 | 10/2001 | Hochrainer et al. | |
| 2003/0171407 | A1 | 9/2003 | Freese et al. | |
| 2003/0199846 | A1 | 10/2003 | Fowles et al. | |
| 2004/0062800 | A1 | 4/2004 | Burnside et al. | |
| 2004/0062802 | A1 | 4/2004 | Hermelin | |
| 2004/0109891 | A1 | 6/2004 | Sanghvi et al. | |
| 2005/0279653 | A1 * | 12/2005 | Williams-Lucas | B65D 51/285 206/219 |
| 2007/0193894 | A1 | 8/2007 | Macken et al. | 206/219 |
| 2008/0008765 | A1 | 1/2008 | Schwarz et al. | |
| 2008/0095855 | A1 | 4/2008 | Schwarz | |
| 2008/0118570 | A1 | 5/2008 | Liu et al. | |
| 2008/0124432 | A1 * | 5/2008 | Ma | B65D 41/3428 426/115 |
| 2008/0202950 | A1 | 8/2008 | Anderson | |
| 2008/0314775 | A1 * | 12/2008 | Owoc | B65D 25/08 206/222 |
| 2009/0123538 | A1 | 5/2009 | Alani et al. | |
| 2009/0142378 | A1 | 6/2009 | Frisbee | 424/400 |
| 2009/0176691 | A1 | 7/2009 | Bennis et al. | |
| 2009/0325938 | A1 | 12/2009 | Lichter et al. | |
| 2010/0092562 | A1 | 4/2010 | Hollenbeck et al. | |
| 2010/0282624 | A1 * | 11/2010 | Paganuzzi | B65D 51/285 206/222 |
| 2010/0330150 | A1 | 12/2010 | Venkatesh et al. | |
| 2011/0268808 | A1 | 11/2011 | Jain et al. | |
| 2011/0313046 | A1 | 12/2011 | Ermer | |
| 2012/0178666 | A1 | 7/2012 | Franklin et al. | |
| 2012/0220930 | A1 | 8/2012 | Griffiths et al. | 604/89 |
| 2013/0109659 | A1 | 5/2013 | Soler Ranzani et al. | |
| 2014/0050796 | A1 | 2/2014 | Tengler et al. | |
| 2014/0309271 | A1 | 10/2014 | Price | |
| 2014/0319141 | A1 | 10/2014 | Stratis et al. | 220/277 |
| 2015/0021214 | A1 * | 1/2015 | Besic | B65D 51/2835 206/222 |
| 2016/0317388 | A1 | 11/2016 | Bhargava et al. | |
| 2017/0119627 | A1 | 1/2017 | Gambino et al. | |
| 2017/0216142 | A1 | 8/2017 | Mittal et al. | |

FOREIGN PATENT DOCUMENTS

| | | | | |
|---|---|---|---|---|
| WO | WO00038655 | A1 | 7/2000 | |
| WO | WO2006030297 | A1 | 3/2003 | |
| WO | WO2008122993 | A1 | 10/2008 | |
| WO | WO2011077451 | A1 | 6/2011 | |
| WO | WO2011107855 | A1 | 9/2011 | |
| WO | WO2011150506 | A1 | 12/2011 | |
| WO | WO2012063257 | A1 | 5/2012 | |
| WO | WO 2013043064 | A1 | 3/2013 | |
| WO | WO 2013091882 | A1 | 6/2013 | |
| WO | WO2014174119 | A1 | 10/2014 | |
| WO | WO 2016/016845 | | 2/2016 | A61J 1/14 |
| WO | WO 2016178131 | A1 | 11/2016 | |
| WO | WO 2017191485 | A1 | 11/2017 | |

OTHER PUBLICATIONS

International Search Report and Written Opinion for International Application No. PCT/IB2016/052488, issued by PCT dated Aug. 31, 2016.

USPTO, Office Action for U.S. Appl. No. 15/148,131 (dated Sep. 29, 2017).

(Anonymous) "EKG Results/Tenex", Dr. Mom's Spot (Mar. 26, 2010) Available at: http://drmomsspot.blogspot.com/2010/03/ekg-results-tenex.html.

Lopez-Liuchi et al., "Therapy for type 2 diabetes: where do we stand after the UK Prospective Diabetes Study?," European Journal of Endocrinology, 140:4-6 (1999).

Target Brands, Inc., Medela Breast Milk Bottle Set (2010 or earlier) Available at: www.target.com/p/medela-breast-mil-set-8oz-3ct/-/A-11189915.

Murtaza,"Ethylcellulose Microparticles: A Review," Drug Research, 69(1):11-22 (2012).

Steeman, "Innovative dispensing bottle caps for sensitive vitamins," Best in Packaging (2009). Available at: http://bestinpackaging.com/2009/05/29/innovative-dispensing-bottle-caps-for-sensitive-vitamins/.

Sun Pharm. Ind. Ltd., Co-pending PCT Application No. PCT/IB2015/053207 filed May 1, 2015, published as WO 2015/166472 (dated Nov. 5, 2015).

U.S. Int'l Search Authority, International Search Report and Written Opinion for International Application No. PCT/IB2015/053207 (dated Aug. 7, 2015).

WIPO, International Preliminary Report on Patentability for International Application No. PCT/IB2015/053207 (dated Mar. 16, 2016).

Kumar et al., Co-pending U.S. Appl. No. 15/133,773, filed Apr. 20, 2016, published as U.S. 2016/0228360 (Aug. 11, 2016).

USPTO, Restriction Requirement for U.S. Appl. No. 15/133,773 (dated Jun. 10, 2016).

USPTO, Office Action for U.S. Appl. No. 15/133,773 (dated Jul. 27, 2016).

USPTO, Final Office Action for U.S. Appl. No. 15/133,773 (dated Dec. 16, 2016).

USPTO, Final Office Action for U.S. Appl. No. 15/133,773 (dated Apr. 13, 2017).

Sun Pharm. Ind. Ltd., Co-pending PCT Application No. PCT/IB2016/052484 filed May 2, 2016, published as WO 2016/178130 (Nov. 10, 2016).

U.S. Int'l Search Authority, International Search Report and Written Opinion for International Application No. PCT/IB2016/052484 (dated Sep. 8, 2016).

Co-pending U.S. Appl. No. 15/144,000, filed May 2, 2016, not yet published.

USPTO, Office Action for U.S. Appl. No. 15/144,000 (dated Jun. 23, 2016).

USPTO, Final Office Action for U.S. Appl. No. 15/144,000 (dated Nov. 4, 2016).

USPTO, Office Action for U.S. Appl. No. 15/144,000 (dated Feb. 14, 2017).

Sun Pharm. Ind. Ltd., Co-pending PCT Application No. PCT/IB2015/053209 filed May 1, 2015, published as WO 2015/166473 (Nov. 5, 2015).

U.S. Int'l Search Authority, International Search Report and Written Opinion for International Application No. PCT/IB2015/053209 (dated Aug. 14, 2015).

WIPO, International Preliminary Report on Patentability for International Application No. PCT/IB2015/053209 (dated Nov. 10, 2016).

(56) References Cited

OTHER PUBLICATIONS

Kumar et al., Co-pending U.S. Appl. No. 15/133,826, filed Apr. 20, 2016, published as U.S. 2016/0228379 (Aug. 11, 2016).
USPTO, Restriction Requirement for U.S. Appl. No. 15/133,826 (dated Jun. 23, 2016).
USPTO, Office Action for U.S. Appl. No. 15/133,826 (dated Jul. 28, 2016).
USPTO, Final Office Action for U.S. Appl. No. 15/133,826 (dated Dec. 20, 2016).
USPTO, Office Action for U.S. Appl. No. 15/133,826 (dated Feb. 14, 2017).
Co-pending PCT Application No. PCT/IB2016/052604 filed May 6, 2016, not yet published.
U.S. Int'l Search Authority, International Search Report and Written Opinion for International Application No. PCT/IB2016/052604 (dated Aug. 31, 2016).
Singh et al., Co-pending U.S. Appl. No. 15/148,069, filed May 6, 2016, published as U.S. 2016/0271070 (Sep. 22, 2016).
USPTO, Restriction Requirement for U.S. Appl. No. 15/148,069 (dated Jul. 21, 2016).
USPTO, Office Action for U.S. Appl. No. 15/148,069 (dated Nov. 2, 2016).
USPTO, Final Office Action for U.S. Appl. No. 15/148,069 (dated Mar. 20, 2017).
Co-pending PCT Application No. PCT/IB2016/052607 filed May 6, 2016, not yet published.
U.S. Int'l Search Authority, International Search Report and Written Opinion for International Application No. PCT/IB2016/052607 (dated Sep. 2, 2016).
Singh et al., Co-pending U.S. Appl. No. 15/148,131, filed May 6, 2016, published as U.S. 2016/0346233 (Dec. 1, 2016).
USPTO, Office Action for U.S. Appl. No. 15/148,131 (dated Oct. 7, 2016).
USPTO, Final Office Action for U.S. Appl. No. 15/148,131 (dated Apr. 5, 2017).
Sun Pharm. Ind. Ltd., Co-pending PCT Application No. PCT/IB2016/052485 filed May 2, 2016, published as WO 2016/178131 (dated Nov. 10, 2016).
U.S. Int'l Search Authority, International Search Report and Written Opinion for International Application No. PCT/IB2016/052485 (dated Aug. 31, 2016).
Singh, Co-pending U.S. Appl. No. 15/144,026, filed May 2, 2016, published as U.S. 2016/0346235 (dated Dec. 1, 2016).
USPTO, Office Action for U.S. Appl. No. 15/144,026 (dated Oct. 12, 2016).
USPTO, Final Office Action for U.S. Appl. No. 15/144,026 (dated Apr. 6, 2017).
Sun Pharm. Ind. Ltd., Co-pending PCT Application No. PCT/IB2015/055780 filed Jul. 30, 2015, published as WO 2016/016845 (Feb. 4, 2016).
U.S. Int'l Search Authority, International Search Report and Written Opinion for International Application No. PCT/IB2015/055780 (dated Dec. 7, 2015).
WIPO, International Preliminary Report on Patentability for International Application No. PCT/IB2015/055780 (dated Feb. 9, 2017).
Co-pending U.S. Appl. No. 15/329,070, filed Jan. 25, 2017, not yet published.
Sun Pharm. Ind. Ltd., Co-pending PCT Application No. PCT/IB2016/052486 filed May 2, 2016, published as WO 2016/178132 (dated Nov. 10, 2016).
U.S. Int'l Search Authority, International Search Report and Written Opinion for International Application No. PCT/IB2016/052486 (dated Sep. 9, 2016).
Bhargava, Co-pending U.S. Appl. No. 15/144,058, filed May 2, 2016, published as U.S. 2016/0317388 (Nov. 3, 2016).
USPTO, Restriction Requirement for U.S. Appl. No. 15/144,058 (dated Sep. 30, 2016).
USPTO, Office Action for U.S. Appl. No. 15/144,058 (dated Dec. 16, 2016).
USPTO, Office Action for U.S. Appl. No. 15/144,058 (dated May 11, 2017).
USPTO, Final Office Action for U.S. Appl. No. 15/144,058 (dated Jul. 13, 2017).
Bhargava, Co-pending U.S. Appl. No. 15/352,993, filed Nov. 16, 2016, published as U.S. 2017/0119627 on May 4, 2017.
USPTO, Office Action for U.S. Appl. No. 15/352,993 (dated Mar. 24, 2017).
USPTO, Office Action for U.S. Appl. No. 15/133,773 (dated Aug. 1, 2017).
USPTO, Office Action for U.S. Appl. No. 15/148,069 (dated Aug. 10, 2017).
USPTO, Office Action for U.S. Appl. No. 15/144,026 (dated Aug. 24, 2017).
USPTO, Office Action for U.S. Appl. No. 15/352,993 (dated Aug. 24, 2017).
USPTO, Final Office Action for U.S. Appl. No. 15/144,000 (dated Aug. 24, 2017).
Office Action for U.S. Appl. No. 15/329,070, issued by USPTO dated Nov. 21, 2017.
International Preliminary Report on Patentability for International Application No. PCT/IB2016/052486, issued by WIPO dated Nov. 16 2017.
Office Action for U.S. Appl. No. 15/144,058, issued by USPTO dated Jan. 16, 2018.
CIP U.S. Appl. No. 15/853,219, filed Dec. 22, 2017, not yet published.
Final Office Action for U.S. Appl. No. 15/352,993, issued by USPTO dated Feb. 8, 2018.
EP Extended Search Report dated Feb. 16, 2018 for European Patent Application No. 15827750.9.
Office Action for AU Application No. 2017279809, issued by AU PTO dated Jun. 1, 2018.
Office Action for AU Application No. 2017254908, issued by AU PTO dated Jun. 1, 2018.

* cited by examiner

Figure 1: Schematic diagram of the components of a dual-chamber pack
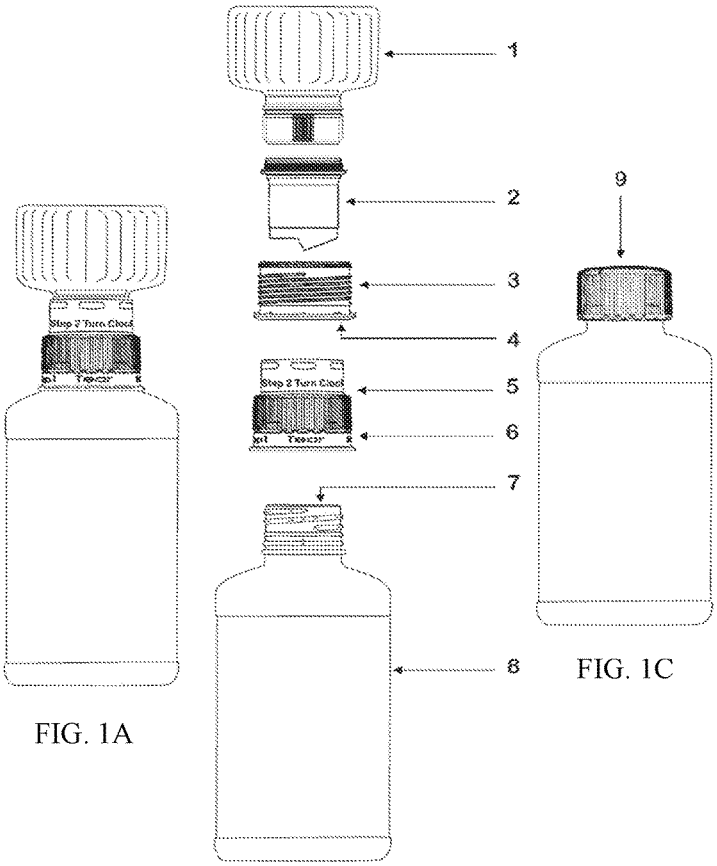
Reservoir - 1, Plunger - 2, Plug - 3, Breakable polymeric membrane - 4, Biphasic connector - 5, Tamper evident band - 6, Opening of the container -7, Container - 8, Cap - 9.

Figure 2. Schematic diagram for the biphasic connector – top view and front view

Top view

Front view

Tapered design for no product retention – A, Cross-sectional ribs for imparting strength to the component – B, Locking mechanism – C, Tamper evident band – D.

Figure 3: Schematic diagram representing the assembly of a dual-chamber pack

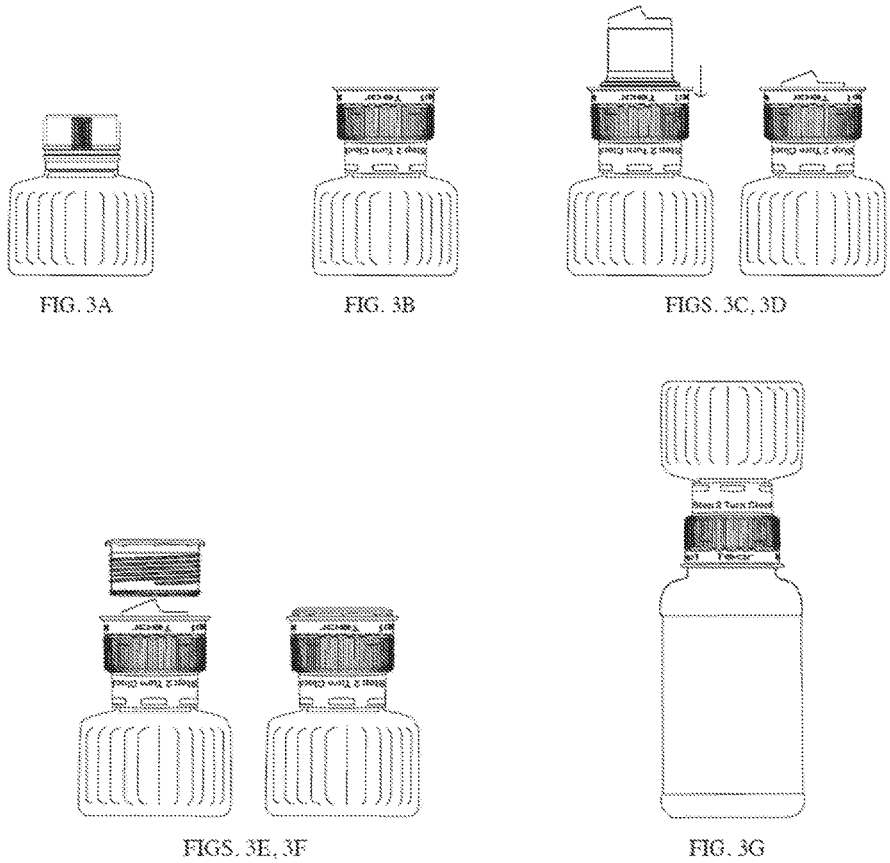

FIG. 3A. Prefilling the reservoir with a solid composition.
FIG. 3B. Outer shell of biphasic connector is affixed with the reservoir.
FIGS. 3C, 3D. Plunger is placed inside the biphasic connector.
FIGS. 3E, 3F. Plug is fixed with the biphasic connector to complete the second chamber.
FIG. 3G. Second chamber is inverted and placed over the container of the first chamber prefilled with pharmaceutically acceptable vehicle.

Figure 4: Schematic diagram representing the functioning of a dual-chamber pack

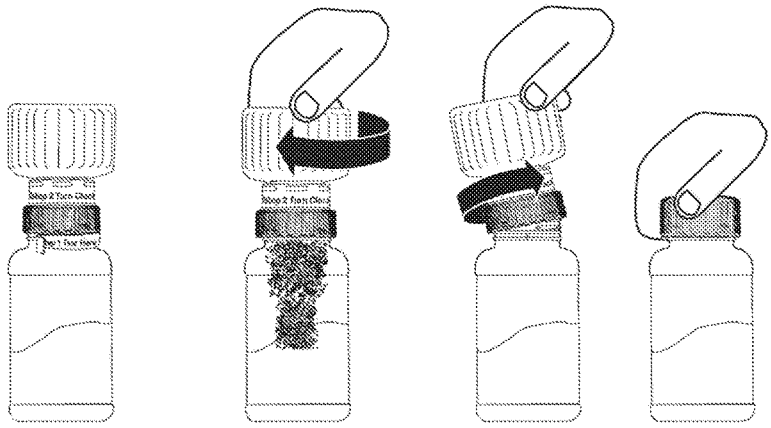

FIG. 4A FIG. 4B FIGS. 4C, 4D

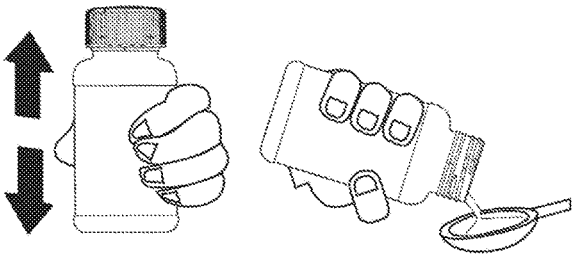

FIGS. 4E, 4F

FIG. 4A. Remove the tear band.

FIG. 4B. Screw the top chamber clockwise to break the polymeric membrane in the plug, which makes the solid composition fall into the container of the first chamber prefilled with pharmaceutically acceptable vehicle.

FIGS. 4C, 4D. Remove the second chamber from the neck of the container of the first chamber and replace it with a child-resistant cap.

FIGS. 4E, 4F. Shake well to mix before administration.

Figure 5: Schematic diagram of the components of a dual-chamber pack
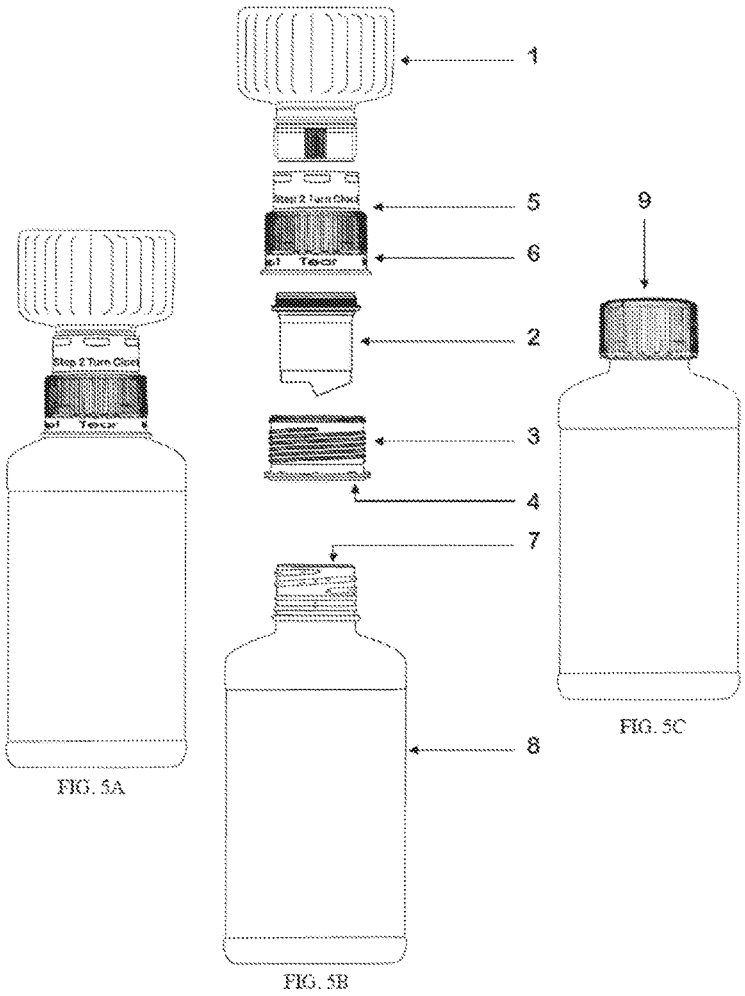
Reservoir - 1, Plunger - 2, Plug - 3, Breakable polymeric membrane - 4, Biphasic connector - 5, Tamper evident band - 6, Opening of the container -7, Container - 8, Cap - 9.

Figure 6: Cross-section diagram of second chamber of dual-chamber pack before and after activation.

Reservoir - 1, Plunger - 2, Plug - 3, Breakable polymeric membrane - 4, Biphasic connector - 5, Tamper evident band - 6.

DUAL-CHAMBER PACK FOR PHARMACEUTICAL COMPOSITIONS

FIELD OF THE INVENTION

The present invention relates to a dual-chamber pack with a first chamber comprising a container; and a second chamber comprising a reservoir, a biphasic connector, a plunger, and a plug with a breakable polymeric membrane. The container of the first chamber is prefilled with a pharmaceutically acceptable vehicle and the reservoir of the second chamber is prefilled with a solid composition of an active ingredient, wherein the solid composition of the active ingredient is mixed with the pharmaceutically acceptable vehicle to form a liquid pharmaceutical composition upon activation of the dual-chamber pack.

BACKGROUND OF THE INVENTION

Liquid pharmaceutical compositions are convenient dosage forms for oral administration particularly for geriatric and pediatric patients in comparison to solid dosage forms such as tablets and capsules. They are easy to administer which leads to enhanced patient compliance. Additionally, liquid pharmaceutical compositions provide a unique advantage of having a flexible dosing regimen. Liquid pharmaceutical compositions are generally in the form of a solution or a suspension, wherein the active ingredient remains in the dissolved or dispersed form in a pharmaceutically acceptable vehicle such as water.

However, some of the active ingredients remain unstable in the presence of pharmaceutically acceptable vehicle such as water when stored for a prolonged period of time. To overcome this, the active ingredients are mostly formulated as a dry powder which is to be reconstituted with the pharmaceutically acceptable vehicle at the time of administration. The reconstitution is done by the end user, wherein the dry powder is dissolved or suspended in household pre-boiled and cooled water to form a liquid pharmaceutical composition. Alternatively, the pharmaceutically acceptable vehicle or purified water is supplied separately along with the bottle having the dry powder. This conventional pack lacks patient compliance and may lead to contamination due to improper quality of water. Further, there remains a possibility of dosing errors if the pharmaceutically acceptable vehicle or water is not added to the marked level.

U.S. Pat. Nos. 1,156,369; 3,601,469; 3,840,136; and 4,982,875 disclose the use of dual-chamber packs for separately storing two compositions in two compartments which can be admixed at the time of use. The two compartments are separated by a breakable membrane which is ruptured by the depression of a plunger so that the one composition gets released into another and is mixed. However, there remains a possibility that the membrane fragments may get detached and fall into the final product. This may lead to undesirable contamination and can pose serious health hazards. Furthermore, the dual-chamber packs disclosed in the prior art have a limited capacity for the compartments which may not be suitable for high-dose drugs or for drugs which require chronic administration. Also, the liquid composition may get permeated into the solid composition across the membrane during storage which can lead to the agglomeration of the solid composition. This may result in poor flow of the solid composition, thus affecting the content uniformity of the final product. Also, the liquid composition on permeation can affect the stability of moisture-sensitive drugs.

The present invention provides a patient compliant dual-chamber pack with a significant improvement over the prior art and which fulfills the unmet need of incorporating variety of drugs. The present dual-chamber pack can be suitable for any class of drugs including the high-dose drugs, drugs requiring chronic administration, or moisture-sensitive drugs. Multi-dose liquid compositions can be conveniently administered using this pack. Further, the plunger used in the pack of the instant invention is designed in a way such that the breakable membrane remains adhered to the plug at the time of activation and membrane fragments do not fall into the final product. During activation, the pack ensures that the final product remains safe for the use of patients. The pack also ensures that the solid composition is completely released into the liquid composition thereby maintaining the content uniformity of the final product. Further, the pack also ensures that there is no permeation of moisture into the chamber having solid composition comprising the active ingredient, and the stability of the active ingredient remains unaffected during storage.

SUMMARY OF THE INVENTION

The present invention relates to a dual-chamber pack with a first chamber comprising a container; and a second chamber comprising a reservoir, a biphasic connector, a plunger, and a plug with a breakable polymeric membrane. The container of the first chamber is prefilled with a pharmaceutically acceptable vehicle and the reservoir of the second chamber is prefilled with a solid composition of an active ingredient, wherein the solid composition of the active ingredient is mixed with the pharmaceutically acceptable vehicle to form a liquid pharmaceutical composition upon activation of the dual-chamber pack. The pack allows the end-users ease of dispensing with only a few simple steps required for reconstitution. The pack is suitable for drugs required for chronic administration, high-dose drugs, and moisture-sensitive drugs. The pack ensures that the solid composition falls completely into the pharmaceutically acceptable vehicle thereby maintaining the content uniformity. The pack also ensures that final product remains free of any contamination from the pack components and is safe to the end-users. Further, the pack ensures the stability of the active ingredient during storage.

BRIEF DESCRIPTION OF THE DRAWINGS

FIG. 1: Schematic diagram of the components of a dual-chamber pack

FIG. 3: Schematic diagram representing the assembly of a dual-chamber pack FIG. 4: Schematic diagram representing the functioning of a dual-chamber pack FIG. 5: Schematic diagram of the components of a dual-chamber pack.

DETAILED DESCRIPTION OF THE INVENTION

Figures 2A, 2B:
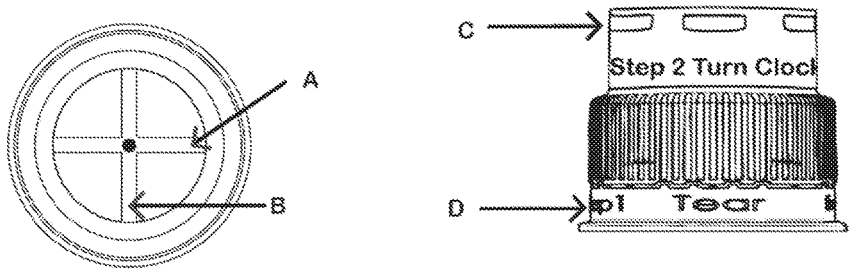
FIG. 2: Schematic diagram for the biphasic connector—top view and front view
Figure 6A:
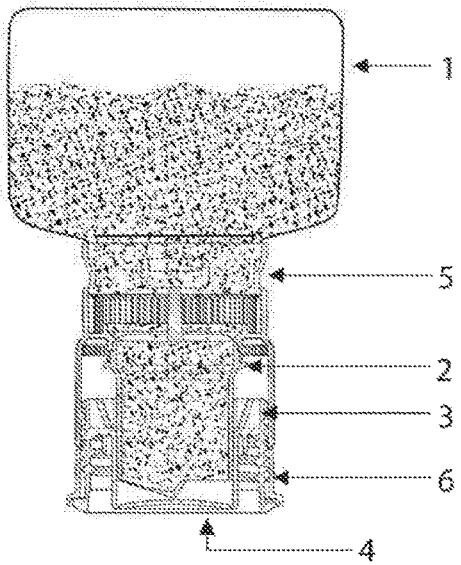
FIGS. 6A and 6B: Cross-section diagram of second chamber of dual-chamber pack before and after activation.
Figure 6B:
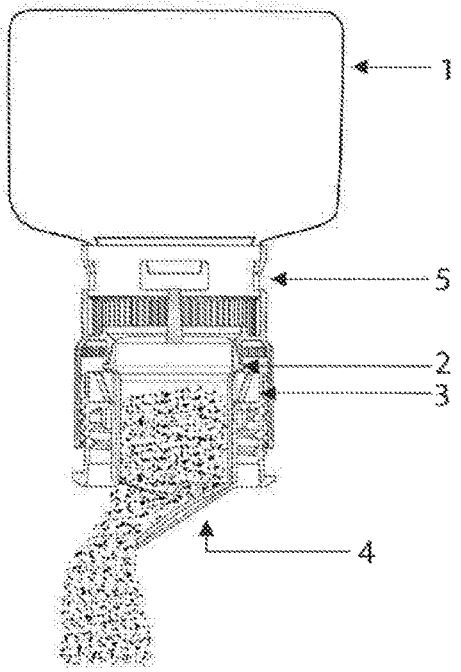

A first aspect of the invention provides a dual-chamber pack comprising:

(a) a first chamber comprising a container; and (b) a second chamber comprising a reservoir, a biphasic connector, a plunger, and a plug with a breakable polymeric membrane.

According to one embodiment of the above aspect, the container of the first chamber is prefilled with a pharmaceutically acceptable vehicle and the reservoir of the second chamber is prefilled with a solid composition of an active ingredient. Alternatively, the reservoir of the second chamber is prefilled with a liquid concentrate composition of an active ingredient.

According to another embodiment of the above aspect, the solid composition is mixed with the pharmaceutically acceptable vehicle to form a liquid pharmaceutical composition upon activation of the dual-chamber pack.

According to another embodiment of the above aspect, the liquid pharmaceutical composition is a solution or a suspension.

According to another embodiment of the above aspect, the dual chamber pack is used for multi-dose administration of the liquid pharmaceutical composition.

According to another embodiment of the above aspect, the reservoir of the second chamber is prefilled with the solid composition in a volume greater than about 30 cc. In a preferred embodiment of above aspect, the reservoir of the second chamber is prefilled with the solid composition in a volume ranging from about 30 cc to about 500 cc.

According to another embodiment of the above aspect, the biphasic connector of the second chamber connects the reservoir to the container of the first chamber.

According to another embodiment of the above aspect, the plunger ensures the breakable polymeric membrane remains attached to the plug during activation.

According to another embodiment of the above aspect, the plunger comprise of one or more sharp projections with an essential continuous blunt area. In a preferred embodiment, the plunger comprise of one sharp projection with an essential continuous blunt area. The plunger can further have one or more grooves. The body of the plunger can be in the form of a cylinder or a funnel.

According to another embodiment of the above aspect, the plug is made up of polymeric materials selected from the group comprising polyolefin, polyethylene, polypropylene, polyvinyl chloride, cyclic olefin polymer, cyclic olefin copolymer, polyethylene terephthalate, polyethylene terephthalate-G, polypropylene, and polycarbonate. In a preferred embodiment, the plug is made up of polyethylene.

According to another embodiment of the above aspect, the plug additionally includes one or more moisture barrier additives.

According to another embodiment of the above aspect, the moisture barrier additives are selected from the plastic additive group comprising of monomers and co-polymers that get activated through polymerization process to form an effective organic chemical.

According to another embodiment of the above aspect, the moisture barrier additives improve the moisture barrier properties by up to 50%. In particular, the moisture barrier additives improve the moisture barrier properties by up to 30%.

According to another embodiment of the above aspect, the plug with the breakable polymeric membrane prevents moisture permeation from the first chamber into the second chamber.

According to another embodiment of the above aspect, the liquid pharmaceutical composition is a stable composition.

According to another embodiment of the above aspect, the liquid pharmaceutical composition is a taste-masked composition.

A second aspect of the present invention provides a dual-chamber pack comprising:

a) a first chamber in the form of a container (8) prefilled with a pharmaceutically acceptable vehicle provided with an opening (7) at an upper end;

b) a second chamber comprising:

(i) a reservoir (1) adapted to fit into a plunger (2) prefilled with a solid composition of an active ingredient; the plunger (2) is further adapted to fit into a plug (3) having a top flat surface, (ii) the plug (3), with a breakable polymeric membrane (4), adapted to fit into the biphasic connector (5) optionally having a tamper evident band (6) which is further connected from the lower end to the opening (7) of the container (8);

wherein the reservoir (1) at the top of the second chamber has a means to exert pressure onto the plunger (2) so as to partially rupture the breakable polymeric membrane (4) of the plug and deliver the solid composition into the pharmaceutically acceptable vehicle of the container (8); the second chamber is replaced with a cap (9), and wherein the solid composition is mixed with the pharmaceutically acceptable vehicle to form a liquid pharmaceutical composition.

According to one embodiment of the above aspect, the reservoir of the second chamber is prefilled with the solid composition in a volume greater than about 30 cc. In a preferred embodiment of above aspect, the reservoir of the second chamber is prefilled with the solid composition in a volume ranging from about 30 cc to about 500 cc.

According to another embodiment of the above aspect, the cap is a conventional cap or a child-resistant cap.

According to another embodiment of the above aspect, the biphasic connector has a tamper evident band on the side connected to the container of the first chamber and grooves on another side for locking with the reservoir of the second chamber.

According to another embodiment of the above aspect, the plunger is opened at both the ends.

According to another embodiment of the above aspect, the reservoir exerts pressure onto the plunger when it is screwed during the activation of the dual-chamber pack.

A third aspect of the present invention provides a method of providing a liquid pharmaceutical composition stored in a dual-chamber pack, comprising the steps of:

(a) providing a first chamber comprising a container (8), a second chamber comprising a reservoir (1), a plunger (2), a plug (3) with a breakable polymeric membrane (4), and a biphasic connector (5);

(b) prefilling the container (8) of the first chamber with a pharmaceutically acceptable vehicle to form a first chamber;

(c) prefilling a reservoir (1) of the second chamber with a solid composition;

(d) fixing the biphasic connector (5) into the reservoir (1);

(e) fixing the plunger (2) in the biphasic connector (5);

(f) mounting the plug (3) onto the plunger of the biphasic connector (5) to form the second chamber;

(g) mounting the second chamber onto the opening (7) of the container (8) of the first chamber;

(h) activating the dual-chamber pack by screwing the reservoir (1) of the second chamber so that the plunger partially ruptures the circumference of a breakable polymeric membrane; and (i) removing the second chamber and replacing it with a cap (9); and (j) shaking the container (8) to allow the mixing of the solid composition with the pharmaceutically acceptable vehicle to obtain the liquid pharmaceutical composition.

According to one embodiment of the above aspect, the reservoir of the second chamber is prefilled with the solid composition in a volume greater than about 30 cc. In a preferred embodiment of above aspect, the reservoir of the second chamber is prefilled with the solid composition in a volume ranging from about 30 cc to about 500 cc.

According to another embodiment of above aspect, the biphasic connector has a tamper evident band on the side connected to the container of the first chamber and grooves on another side for locking with the reservoir of the second chamber. The tamper evident band is removed first to start the activation process.

The active ingredient used to form a solid composition of the present invention may be present in a form to provide an immediate release or an extended release. The solid composition may comprise of an active ingredient directly mixed with one or more pharmaceutically acceptable excipients. Alternatively, the solid composition may comprise of cores of an active ingredient, optionally admixed with one or more pharmaceutically acceptable excipients. The cores may be coated with an immediate release or an extended release coating. The immediate release coating may comprise a film-forming agent to mask the taste of bitter active ingredients or to improve the stability. Said coating remains insoluble in the reconstituted liquid pharmaceutical composition during storage and releases the active ingredient only once ingested. The film-forming agent can be a water-soluble polymer in which the release of active ingredient is prevented by using a high molar concentration of the solutes in the reconstituted composition, wherein the solutes have a higher affinity towards water. The high molar concentration of the solutes generates hypertonic conditions leading to high osmolality and thus prevents the leaching of the active ingredient from the coated cores. This would help to mask the taste of the bitter active ingredients or to improve the stability of active ingredients. Further, the film-forming agent can be having a pH-dependent solubility in which the release of active ingredient is prevented by using a pre-adjusted pH of the reconstituted composition such that the film-forming agent does not get dissolved in the reconstituted composition but get dissolved when exposed to the physiological conditions. Alternatively, the solid composition comprises of active ingredient in a complexed form such as ion-exchange resin complex or a cyclodextrin complex, optionally admixed with one or more pharmaceutically acceptable excipients. In this case, the active ingredient is released when exposed to the physiological conditions upon ingestion. The extended release coating may comprise of a pH-dependent release-controlling agent, a pH-independent release-controlling agent, or mixtures thereof.

Suitable examples of pH-dependent release-controlling agents are selected from the group comprising acrylic copolymers such as methacrylic acid and methyl methacrylate copolymers, e.g., Eudragit® L 100 and Eudragit® S 100, methacrylic acid and ethyl acrylate copolymers, e.g., Eudragit® L 100-55 and Eudragit® L 30 D-55, dimethylaminoethyl methacrylate and butyl methacrylate and methyl methacrylate copolymers e.g., Eudragit® E 100, Eudragit® E PO, methyl acrylate and methacrylic acid and octyl acrylate copolymers, styrene and acrylic acid copolymers, butyl acrylate and styrene and acrylic acid copolymers, and ethylacrylate-methacrylic acid copolymer; cellulose acetate phthalate; cellulose acetate succinates; hydroxyalkyl cellulose phthalates such as hydroxypropylmethyl cellulose phthalate; hydroxyalkyl cellulose acetate succinates such as hydroxypropylmethyl cellulose acetate succinate; vinyl acetate phthalates; vinyl acetate succinate; cellulose acetate trimelliate; polyvinyl derivatives such as polyvinyl acetate phthalate, polyvinyl alcohol phthalate, polyvinyl butylate phthalate, and polyvinyl acetoacetal phthalate; zein; shellac; and mixtures thereof.

Suitable examples of pH-independent release-controlling agents are selected from the group comprising cellulosic polymers such as ethyl cellulose, methyl cellulose, hydroxyethyl cellulose, hydroxypropyl cellulose, hydroxyethylmethyl cellulose, hydroxypropylmethyl cellulose, and carboxy methylcellulose; acrylic copolymers such as methacrylic acid copolymers, e.g., Eudragit® RS, Eudragit® RL, Eudragit® NE 30 D; cellulose acetate; polyethylene derivatives e.g., polyethylene glycol and polyethylene oxide; polyvinyl alcohol; polyvinyl acetate; gums e.g., guar gum, locust bean gum, tragacanth, carrageenan, alginic acid, gum acacia, gum arabic, gellan gum, and xanthan gum; triglycerides; waxes, e.g., Compritol®, Lubritab®, and Gelucires®; lipids; fatty acids or their salts/derivatives; a mixture of polyvinyl acetate and polyvinyl pyrrolidone, e.g., Kollidon® SR; and mixtures thereof.

The term "liquid concentrate composition," as used herein refers to a concentrated liquid composition comprising an active ingredient which upon reconstitution gives the desired strength.

According to another embodiment of the above aspects, the core is in the form of a bead, a pellet, a granule, a spheroid, or the like.

According to another embodiment of the above aspects, the active ingredient is layered onto an inert particle to form the core.

The dual chamber pack of the present invention is suitable for multi-dose administration of the active ingredient. The liquid pharmaceutical composition of the present invention is in the form of a suspension or a solution.

The pharmaceutically acceptable vehicle of the instant invention may comprise of purified water, one or more suitable organic solvents, and mixtures thereof. The organic solvents may be selected from the group consisting of ethanol, glycerin, propylene glycol, polyethylene glycol, and mixtures thereof. The pharmaceutically acceptable vehicle may optionally have one or more pharmaceutically acceptable excipients.

The term "activation," as used herein means a process which reconstitutes the solid composition with the pharmaceutically acceptable vehicle to form a liquid pharmaceutical composition. The activation can be done by the end-users such as patients or pharmacists or caregiver. The activation process starts by screwing the reservoir.

The term "multi-dose" as used herein, means the liquid pharmaceutical composition is to be administered in multiple doses after reconstitution, over a period of time e.g., for more than seven days, or more than a month, or more than three months.

The term "about" as used herein, refers to any value which lies within the range defined by a variation of up to ±10% of the value.

The term "stable," as used herein, refers to chemical stability, wherein not more than 5% w/w of total related substances are formed on storage at 40° C. and 75% relative humidity (R.H.) or at 25° C. and 60% R.H. for a period of at least three months to the extent necessary for the sale and use of the composition.

The term "pharmaceutically acceptable excipients," as used herein, refers to excipients that are routinely used in pharmaceutical compositions. The pharmaceutically acceptable excipients may comprise glidants, sweeteners, suspending agents, anti-caking agents, wetting agents, preservatives, buffering agents, flavoring agents, anti-oxidants, chelating agents, solutes, and combinations thereof.

The average diameter of the coated cores ranges from about 10 μm to about 2000 μm, particularly from about 50 μm to about 1000 μm, and more particularly from about 150 μm to about 500 μm. The finer sizes of the cores help in avoiding grittiness in the mouth and are therefore more acceptable.

This dual-chamber pack can be used for a soluble, a water-insoluble, or a poorly-soluble active ingredient. The active ingredient may have a stability problem due to which the active ingredient is reconstituted using a pharmaceutically acceptable vehicle at the time of administration. This dual-chamber pack can be used for active ingredients such as valacyclovir, metformin, azithromycin, cloxacillin, clarithromycin, erythromycin, amoxicillin alone or in combination with clavulanic acid, cefdinir, cefuroxime axetil, cefixime, cefadroxil, cefpodoxime, cefaclor, cefprozil, fluconazole, voriconazole, acarbose, miglitol, voglibose, repaglinide, nateglinide, glibenclamide, glimepride, glipizide, gliclazide, chloropropamide, tolbutamide, phenformin, alogliptin, sitagliptin, linagliptin, saxagliptin, rosiglitazone, pioglitazone, troglitazone, faraglitazar, englitazone, darglitazone, isaglitazone, zorglitazone, liraglutide, muraglitazar, peliglitazar, tesaglitazar, canagliflozin, dapagliflozin, remogliflozin, sergliflozin, verapamil, albuterol, salmeterol, acebutolol, sotalol, penicillamine, norfloxacin, ciprofloxacin, ofloxacin, levofloxacin, moxifloxacin, trovafloxacin, gatifloxacin, tetracycline, demeclocycline hydrochloride, losartan, irbesartan, eprosartan, valsartan, diltiazem, isosorbide mononitrate, ranolazine, propafenone, hydroxyurea, hydrocodone, delavirdine, pentosan polysulfate, abacavir, amantadine, acyclovir, ganciclovir, valganciclovir, saquinavir, indinavir, nelfinavir, lamivudine, didanosine, zidovudine, nabumetone, celecoxib, mefenamic acid, naproxen, propoxyphene, cimetidine, ranitidine, albendazole, mebendazole, thiobendazole, pyrazinamide, praziquantel, chlorpromazine, sumatriptan, bupropion, aminobenzoate, pyridostigmine bromide, potassium chloride, niacin, tocainide, quetiapine, fexofenadine, sertraline, chlorpheniramine, rifampin, methenamine, nefazodone, modafinil, metaxalone, morphine, sevelamer, lithium carbonate, flecainide acetate, simethicone, methyldopa, chlorthiazide, metyrosine, procainamide, entacapone, metoprolol, propanolol hydrochloride, chlorzoxazone, tolmetin, tramadol, bepridil, phenytoin, gabapentin, terbinafine, atorvastatin, doxepine, rifabutin, mesalamine, etidronate, nitrofurantoin, choline magnesium trisalicylate, theophylline, nizatidine, methocarbamol, mycophenolate mofetil, tolcapone, ticlopidine, capecitabine, orlistat, colsevelam, meperidine, hydroxychloroquine, guaifenesin, guanfacine, amiodarone, quinidine, atomoxetine, felbamate, pseudoephedrine, carisoprodol, venlafaxine, etodolac, chondroitin, lansoprazole, pantoprazole, esomeprazole, dexlansoprazole, dexmethylphenidate, methylphenidate, sodium oxybate, valproic acid or its salts, divalproex, topiramate, carbamazepine, oxcarbazepine, isotretinoin, oseltamivir, cholestyramine, nystatin, artemether, lumefantrine, or combination thereof.

The liquid pharmaceutical composition of the present invention may comprise of two or more different active ingredients or incompatible active ingredients.

Suitable film-forming agents include, but not limited to cellulosic polymers e.g., hydroxypropylmethyl cellulose, hydroxypropyl cellulose, polyvinyl acetate, polyvinyl pyrrolidone, acrylic polymers such as these commercially available under the trade mark Eudragit® E and Eudragit® EPO, lipid coating substances such as stearic acid, palmitic acid, and glycerol monostearate; hydrophilic colloids such as alginate, chitosan, carboxymethylcellulose, xanthan gum, carboxy vinyl polymers e.g., Carbomer® 94, polylysine, gelatin; and mixtures thereof.

The ion-exchange resins such as cation- and anion-exchange matrices are known in the art. Few exemplary resin particles that can be used according to the invention include, but are not limited to, Dowex® resins and others made by Dow Chemical; Amberlite®, Amberlyst® and other resins made by Rohm and Haas; Indion® resins made by Ion Exchange, Ltd. (India), Diaion® resins by Mitsubishi; Type AG® and other resins by BioRad; Sephadex® and Sepharose® made by Amersham; resins by Lewatit, sold by Fluka; Toyopearl® resins by Toyo Soda; IONAC® and Whatman® resins sold by VWR; and BakerBond® resins sold by J T Baker; resins having polymer backbones comprising styrene-divinyl benzene copolymers and having pendant ammonium or tetraalkyl ammonium functional groups, available from Rohm and Haas, Philadelphia, and sold under the tradename DUOLITE™ AP143.

Suitable suspending agents are selected from the group comprising cellulose derivatives such as co-processed spray dried forms of microcrystalline cellulose and carboxymethyl cellulose sodium, hydroxypropyl cellulose, hydroxyethyl cellulose, hydroxypropylmethyl cellulose, methylcellulose, carboxymethyl cellulose and its salts/derivatives, and microcrystalline cellulose; carbomers; gums such as locust bean gum, xanthan gum, tragacanth gum, arabinogalactan gum, agar gum, gellan gum, guar gum, apricot gum, karaya gum, sterculia gum, acacia gum, gum arabic, and carrageenan; pectin; dextran; gelatin; polyethylene glycols; polyvinyl compounds such as polyvinyl acetate, polyvinyl alcohol, and polyvinyl pyrrolidone; sugar alcohols such as xylitol and mannitol; colloidal silica; and mixtures thereof. Co-processed spray dried forms of microcrystalline cellulose and carboxymethyl cellulose sodium have been marketed under the trade names Avicel® RC-501, Avicel® RC-581, Avicel® RC-591, and Avicel® CL-611.

Suitable glidants are selected from the group comprising silica, calcium silicate, magnesium silicate, colloidal silicon dioxide, cornstarch, talc, stearic acid, magnesium stearate, calcium stearate, sodium stearyl fumarate, hydrogenated vegetable oil, and mixtures thereof.

Suitable sweeteners are selected from the group comprising saccharine or its salts such as sodium, potassium, or calcium, cyclamate or its salt, aspartame, alitame, acesulfame or its salt, stevioside, glycyrrhizin or its derivatives, sucralose, and mixtures thereof.

Suitable anti-caking agents are selected from the group comprising colloidal silicon dioxide, tribasic calcium phosphate, powdered cellulose, magnesium trisilicate, starch, and mixtures thereof.

Suitable wetting agents are selected from the group comprising anionic, cationic, nonionic, or zwitterionic surfactants, or combinations thereof. Suitable examples of wetting agents are sodium lauryl sulphate; cetrimide; polyethylene glycols; polyoxyethylene-polyoxypropylene block copolymers such as poloxamers; polyglycerin fatty acid esters such as decaglyceryl monolaurate and decaglyceryl monomyristate; sorbitan fatty acid esters such as sorbitan monostearate; polyoxyethylene sorbitan fatty acid esters such as polyoxyethylene sorbitan monooleate; polyethylene glycol fatty acid esters such as polyoxyethylene monostearate; polyoxyethylene alkyl ethers such as polyoxyethylene lauryl ether; polyoxyethylene castor oil; and mixtures thereof.

Suitable preservatives are selected from the group comprising parabens such as methyl paraben and propyl paraben; sodium benzoate; and mixtures thereof.

Suitable buffering agents are selected from the group comprising citric acid, sodium citrate, sodium phosphate, potassium citrate, acetate buffer, and mixtures thereof.

Suitable flavoring agents are selected from the group consisting of peppermint, grapefruit, orange, lime, lemon, mandarin, pineapple, strawberry, raspberry, mango, passion fruit, kiwi, apple, pear, peach, apricot, cherry, grape, banana, cranberry, blueberry, black currant, red currant, gooseberry, lingon berries, cumin, thyme, basil, camille, valerian, fennel, parsley, chamomile, tarragon, lavender, dill, bargamot, *salvia*, aloe vera balsam, spearmint, *eucalyptus*, and combinations thereof.

Suitable anti-oxidants are selected from the group comprising butylated hydroxytoluene (BHT), butylated hydroxyanisole (BHA), sodium metabisulfite, ascorbic acid, propyl gallate, thiourea, tocopherols, beta-carotene, and mixtures thereof.

Suitable chelating agents are selected from the group comprising ethylenediamine tetraacetic acid or derivatives/salts thereof, e.g., disodium edetate; dihydroxyethyl glycine; glucamine; acids, e.g., citric acid, tartaric acid, gluconic acid, and phosphoric acid; and mixtures thereof.

The term "solute," as used herein, refers to pharmaceutically acceptable inert agents that have high affinity for the pharmaceutically acceptable vehicle. The solutes generates hypertonic conditions leading to high osmolality and thus prevents the leaching of the active ingredient from the coated cores. The solutes can be present in the pharmaceutically acceptable vehicle or in the solid composition or both. Suitable solutes are selected from the group comprising carbohydrates such as xylitol, mannitol, sorbitol, arabinose, ribose, xylose, glucose, fructose, mannose, galactose, sucrose, maltose, lactose, dextrose and raffinose; water-soluble salts of inorganic acids such as magnesium chloride, magnesium sulfate, potassium sulfate, lithium chloride, sodium chloride, potassium chloride, lithium hydrogen phosphate, sodium hydrogen phosphate, potassium hydrogen phosphate, lithium dihydrogen phosphate, sodium dihydrogen phosphate, potassium dihydrogen phosphate, and sodium phosphate tribasic; water-soluble salts of organic acids such as sodium acetate, potassium acetate, magnesium succinate, sodium benzoate, sodium citrate, and sodium ascorbate; water-soluble amino acids such as glycine, leucine, alanine, methionine; urea or its derivatives; propylene glycol; glycerin; polyethylene oxide; xanthan gum; hydroxypropylmethyl cellulose; and mixtures thereof. Particularly, the solutes used are xylitol, mannitol, glucose, lactose, sucrose, and sodium chloride.

The cores of the present invention comprising the active ingredient can be prepared by any method known in the art, e.g., extrusion-spheronoization, wet granulation, dry granulation, hot-melt extrusion granulation, spray drying, and spray congealing. Alternatively, the active ingredient can be layered onto an inert particle to form the core. Further, the active ingredient particles can be directly coated with a film forming layer to form the microparticles or microcapsules. The microparticles or microcapsules can be prepared by a process of homogenization, solvent evaporation, coacervation phase separation, spray drying, spray congealing, polymer precipitation, or supercritical fluid extraction. The ion-exchange resins comprise loading a plurality of the resin particles with the active ingredient to form drug-resin cores. Methods of loading active ingredients onto the resin particles are generally known in the art.

The first chamber includes a container which is in the form of a glass or a plastic or a metallic bottle. The reservoir of the second chamber can be made of a plastic, a metal or a glass; particularly the reservoir is a plastic bottle. The reservoir of the second chamber may additionally have a slippery coating or mold polishing. This coating or polishing will help to improve the flow characteristics of the solid composition during activation.

The dual-chamber pack is suitable for incorporating solid composition in a volume of greater than about 30 cc. In the dual-chamber pack, the plunger is opened at both the ends. The biphasic connector comprises of cross bridges to give the strength. The bridges can be tapered at the edges to avoid any powder deposit. Further, the reservoir can have serrations to have better grip for the end-users. The biphasic connector have a tamper-evident band on the side connected to the container of the first chamber which is removed first to start the activation process. The biphasic connector is having grooves on other side for locking with the reservoir. On this side, there would be instructions for the end-users regarding direction of the rotation such as clockwise rotation for activating the pack.

The term "tamper-evident band," as used herein, refers to a band attached co-axially to the biphasic connector. The band breaks easily on pulling apart. The tamper-evident band ensures the overall integrity of the product until activation.

The plunger of the instant invention can comprise of one or more sharp projections with an essential continuous blunt area. In particular, the plunger comprise of one sharp projection with an essential continuous blunt area. Alternatively, the plunger can have a single continuous projection with a remaining continuous blunt area which can be called as a flute shaped plunger. The plunger can further have one or more grooves. The body of the plunger can be in the form of a cylinder or a funnel. The funnel shaped plunger provides additional capacity for storing high-dose active ingredients or active ingredients required for chronic administration.

The plunger used in the instant invention ensures that the breakable polymeric membrane remains attached to the plug during activation. The plug and the plunger may be made up of a polymeric material selected from the group comprising polyolefin, polyethylene, polypropylene, polyvinyl chloride, cyclic olefin polymer, cyclic olefin co-polymer, polyethylene terephthalate, polyethylene terephthalate-G, polypropylene, and polycarbonate. Particularly, the plug and the plunger are made up of polyethylene. More particularly, the plug and the plunger are made up of linear low density polyethylene (LLDPE).

The compositions of the first and second chambers of the container are separated by a polymeric breakable membrane of the plug. The plunger used in the instant invention helps to rupture the breakable polymeric membrane upon the application of pressure by a screw-based mechanism. When pressure is applied on the reservoir, the breakable polymeric membrane is ruptured by the plunger. The intact polymeric membrane remains attached to the circumference of the plug. In cases, where a bottle liner exists between the first and the second chambers, the plunger would break the bottle liner in the same manner as it ruptures the breakable polymeric membrane. The unabridged part of the bottle liner remains attached to the opening of the container. The plug with the breakable polymeric membrane prevents moisture permeation from the first chamber into the second chamber.

The material used for making the plug may also include moisture barrier additives selected from the plastic additive group comprising of monomers and co-polymers that get activated through polymerization process to form an effective organic chemical. The moisture barrier additives used in the present invention may include any material that prevent moisture permeation. The moisture barrier additives may be present in the form of a layer inside the plug. The moisture barrier additives may be present in an amount of 0.1% to 10% w/w, in particularly, 0.5% to 5% w/w based on total weight of the material used for making plug.

The material used for making the reservoir may also include the moisture barrier additives. The moisture barrier additives may be present in the form of a layer inside the reservoir.

The moisture permeation test was carried out on dual chamber packs with moisture barrier additives and without moisture barrier additives as per USP (37)-671 Containers Performance Testing. The moisture barrier additives used in the present invention improve the moisture barrier properties by up to 50%. In particular, the moisture barrier additives improves the moisture barrier properties by up to 30%.

The use of moisture barrier additives thus help to prevent the moisture permeation from the pharmaceutically acceptable vehicle into the solid composition comprising the active ingredient during storage. The active ingredient, particularly moisture-sensitive active ingredients thus remains stable during storage.

We claim:

1. A dual-chamber pack comprising:

(a) a first chamber comprising a container prefilled with a pharmaceutically acceptable vehicle; and (b) a second chamber comprising a reservoir prefilled with a solid composition, a biphasic connector, a plunger, and a plug with a breakable polymeric membrane, wherein the biphasic connector connects the reservoir of the second chamber to the container of the first chamber and the pack is activated by screwing the reservoir, wherein:

(i) the biphasic connector, plunger, and plug provide storage capacity for the solid composition, and the reservoir of the second chamber provides additional storage capacity for the solid composition, (ii) the breakable polymeric membrane is attached to the plug and separates the first and second chambers, (iii) the plunger is open at its top and bottom, (iv) the plunger is wholly located within the biphasic connector and plug, and not within the reservoir, and (v) the reservoir, biphasic connector, plunger, and plug are separate components that can be assembled to form part of the dual chamber pack.

2. The dual-chamber pack of claim 1, wherein the pharmaceutically acceptable vehicle is mixed with the solid composition to form a liquid pharmaceutical composition upon activation of the dual-chamber pack.

3. The dual-chamber pack of claim 2, wherein the liquid pharmaceutical composition is a solution or a suspension.

4. The dual-chamber pack of claim 2, wherein the liquid pharmaceutical composition is a stable composition.

5. The dual-chamber pack of claim 1, wherein the plunger ensures the breakable polymeric membrane remains attached to the plug during activation.

6. The dual-chamber pack of claim 1, wherein the plunger comprises one or more sharp projections with an essential continuous blunt area.

7. The dual-chamber pack of claim 1, wherein the plug includes one or more moisture barrier additives.

8. The dual-chamber pack of claim 1, wherein the second chamber is replaced with a cap after activation.

9. The dual-chamber pack of claim 1, wherein the plunger is funnel shaped.

10. The dual-chamber pack of claim 1, wherein the reservoir is prefilled with a solid composition in a volume greater than about 30 cc.

11. The dual-chamber pack of claim 1, wherein the reservoir is prefilled with a solid composition in a volume between about 30 cc and about 500 cc.

* * * * *